US009079191B2

(12) United States Patent
Gila et al.

(10) Patent No.: US 9,079,191 B2
(45) Date of Patent: Jul. 14, 2015

(54) APPARATUS TO CAPTURE AEROSOLS, FLUID JETTING APPARATUS, AND AEROSOL DIVERTERS

(75) Inventors: Omer Gila, Cupertino, CA (US); Napoleon J. Leoni, San Jose, CA (US); Jeffrey Nielsen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1101 days.

(21) Appl. No.: 13/098,349

(22) Filed: Apr. 29, 2011

(65) Prior Publication Data

US 2012/0272896 A1 Nov. 1, 2012

(51) Int. Cl.

| | |
|---|---|
| ***B05C 11/10*** | (2006.01) |
| ***B05B 1/10*** | (2006.01) |
| ***B03C 3/41*** | (2006.01) |
| ***B03C 3/36*** | (2006.01) |
| ***B03C 3/47*** | (2006.01) |

(52) U.S. Cl.

CPC . *B03C 3/41* (2013.01); *B03C 3/368* (2013.01); *B03C 3/47* (2013.01); *B03C 2201/04* (2013.01)

(58) Field of Classification Search

None

See application file for complete search history.

(56) References Cited

U.S. PATENT DOCUMENTS

| | | | | | |
|---|---|---|---|---|---|
| 3,853,750 | A | * | 12/1974 | Volsy | 209/127.1 |
| 4,596,990 | A | * | 6/1986 | Hou | 347/41 |
| 5,528,271 | A | * | 6/1996 | Ebisawa | 347/34 |
| 6,017,111 | A | * | 1/2000 | Kurata | 347/34 |
| 6,302,331 | B1 | | 10/2001 | Dvorsky et al. | |
| 6,554,410 | B2 | * | 4/2003 | Jeanmaire et al. | 347/77 |
| 2008/0018707 | A1 | * | 1/2008 | Masuyama et al. | 347/55 |

* cited by examiner

*Primary Examiner* — Charles Capozzi

(74) *Attorney, Agent, or Firm* — Chad A Pahnke

(57) ABSTRACT

Apparatus to capture aerosols, fluid jetting apparatus, and aerosol diverters are disclosed. An example aerosol capture apparatus includes a corona wire to generate ions, and a reference plate positioned below the corona wire and above a substrate on which a fluid is to be deposited, the reference plate to provide a reference potential to direct the ions toward the reference plate to force aerosol particles associated with the fluid toward the reference plate.

16 Claims, 5 Drawing Sheets

APPARATUS TO CAPTURE AEROSOLS, FLUID JETTING APPARATUS, AND AEROSOL DIVERTERS

BACKGROUND

Fluid jetting devices such as inkjet printers eject fluid droplets toward a substrate to accurately place the fluid droplets at desired locations on the substrate. Often, fluid jetting devices also eject smaller fluid particles in addition to the fluid droplets. These smaller particles do not necessarily reach the substrate, and may instead form as aerosol that travels to other areas of the fluid jetting device.

DETAILED DESCRIPTION

Figure 1:
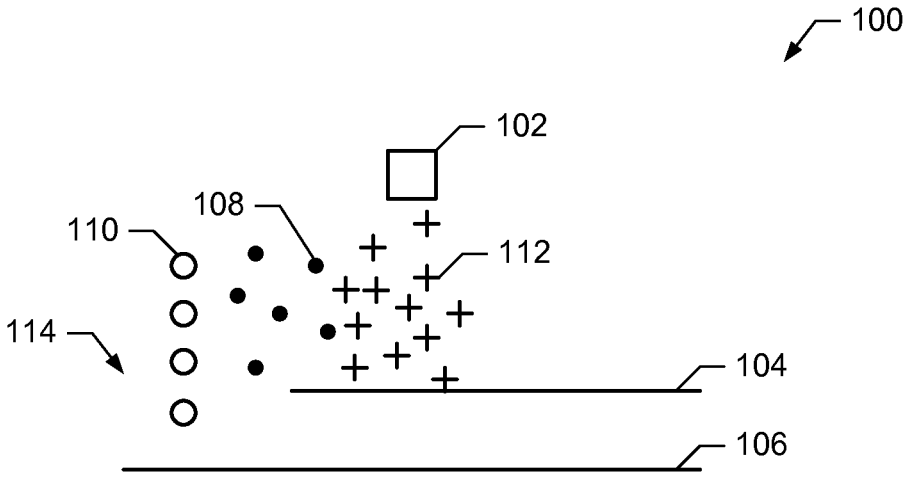
FIG. 1 illustrates an example aerosol collector, constructed in accordance with the teachings herein.

As mentioned above, fluid jetting devices such as inkjet printers often produce undesirable aerosol particles in addition to droplets of fluid. While the aerosol particles may initially be directed toward a substrate, at least a portion of the aerosol particles do not reach the substrate. Instead, the aerosol particles disperse within the air. The aerosol particles may eventually land on other surfaces and/or escape into an external environment, causing contamination to other fluids, posing potential health and/or environmental risks, and/or reducing the performance of a fluid jetting device. To reduce or prevent the aerosol particles from escaping or contaminating other portions of the device, some jetting devices include aerosol collection systems. Known aerosol collection systems include devices to draw aerosol particles into an active filter via suction. Alternatively, corona wires can be activated to generate a stream of ions to capture the aerosols and force them to land on a desired collection surface. Some corona wires operate at relatively high voltages (e.g., 3 kilovolts or higher) depending on the distance between the corona wire and a ground or reference potential. The farther the corona wire is from the ground or reference potential, the higher the voltage must be in order to generate ions.

Example aerosol collection apparatus disclosed herein allow corona wires to be used to capture aerosol particles when fluids are jetted onto relatively thick non-conductive substrates. In contrast to known aerosol collection systems, example aerosol collection apparatus disclosed herein include a reference plate positioned between a corona wire and a thick substrate to achieve efficient, low-current aerosol collection and/or capture. As used herein, "thick" substrates refer to substrates which are relatively thicker than typical substrates, such as sheets of paper. In some examples, thick substrates include substrates that have a thickness of about 1 millimeter or more. Example thick substrates that may be advantageously used with the disclosed example methods and apparatus include assay plates, corrugated cardboards, and/or textiles. Examples of assay plates that may be advantageously used in combination with the apparatus disclosed herein include microplates conforming to the ANSI/SBS 1-2004, ANSI/SBS 2-2004, ANSI/SBS 3-2004, and ANSI/SBS 4-2004 microplate standards.

An example application of example methods and apparatus disclosed herein is capturing aerosol particles in a dose-response fluid jetting system. Such an example fluid jetting system applies specified doses of a material into discrete containers to, for example, test for reactions between the material and a second material in the containers. Known fluid jetting systems for such applications use vacuum suction to eliminate aerosol particles from the air between the fluid jetting heads and the containers. Such methods leave fluid aerosol particles in the air, where the aerosol particles can contaminate dose-response experiments and/or escape into an outside environment. The containers are thick relative to substrates typically used in inkjet printing applications (e.g., relative to paper). Known aerosol capture apparatus used in inkjet apparatus, such as corona wires, use a voltage dependent on the distance between the corona wire and a surface having a reference potential. As the thickness of the substrate increases, the substrate will be charged more quickly at high voltages and low currents. If the substrate becomes sufficiently charged the corona wire ceases to generate ions to capture aerosols and, thus, aerosols are able to escape from the printer. Accordingly, known aerosol capture apparatus are less effective at capturing aerosol particles when using relatively thick substrates. Example aerosol capture apparatus disclosed below efficiently capture aerosol particles in these example applications and avoid contamination, potential health and environmental risks, and performance reductions of prior art devices.

In contrast to some known active filters, some example methods and apparatus disclosed herein do not use a filter that requires regular maintenance. Instead, these disclosed example methods and apparatus use a consumable or disposable plate or other surface that may be easily removed and replaced. Additionally, example methods and apparatus disclosed below generate less noise, use less power, are less expensive to implement and manufacture, and leave fewer fluid deposits that could result in slow release into the air. In some applications, leftover fluids of different types may create incompatible mixtures, causing health and/or environmental hazards. Example methods and apparatus disclosed herein reduce the risk of such incompatible mixtures by more effectively removing fluid aerosols from fluid jetting apparatus.

FIG. 1 illustrates an example aerosol collector 100. The example aerosol collector 100 of FIG. 1 includes a corona wire 102 and a reference plate 104 located between the corona wire 102 and a substrate 106. The aerosol collector 100 of FIG. 1 may be used to collect aerosol particles 108 in fluid jetting devices in which the substrate 106, onto which fluid droplets 110 are to be jetted, is relatively thick (e.g., more than about 1 mm thick).

To reduce or prevent contamination from dispersion of the aerosol particles 108, the example corona wire 102 generates a plurality of ions 112, which are directed toward the reference plate 104 by an electric field (e.g., an electric potential gradient between the corona wire 102 and the reference plate 104). The reference plate 104 provides an electrical ground or reference potential (e.g., 0 V) to which a voltage applied to the corona wire 102 is referenced. The movement of the ions 112 causes a corona wind, which is a movement of air in the travel direction of the ions 112. The aerosol particles 108 traveling between the corona wire 102 and the reference plate 104 are forced toward the reference plate 104 by the ions 112, which charge the aerosol particles but do not substantially charge the substrate 106. The electrical potential gradient between the corona wire 102 and the reference plate 104 then urges the charged aerosol particles 108 toward a collection surface such as the substrate 106. The example reference plate 104 of FIG. 1 includes an opening 114 through which the fluid droplets 110 travel to reach the substrate 106. The example opening is large enough for the fluid droplets 110 to travel to the substrate 106 in desired locations and/or areas. Thus, the reference plate 104 allows the fluid droplets 110 to travel to the substrate while providing a reference potential for the corona wire 102 to generate the ions 112. In examples in which the fluid droplets 110 are deposited in limited location(s) on the substrate 106 (e.g., in collection containers linearly arranged in a path of travel of the substrate 106), the opening 114 may be relatively small. In contrast, in examples in which the fluid droplets 110 are deposited in a wider area on the substrate 106, the opening 114 may be larger than if the droplets 110 are to be deposited in more limited location(s).

Figure 2:
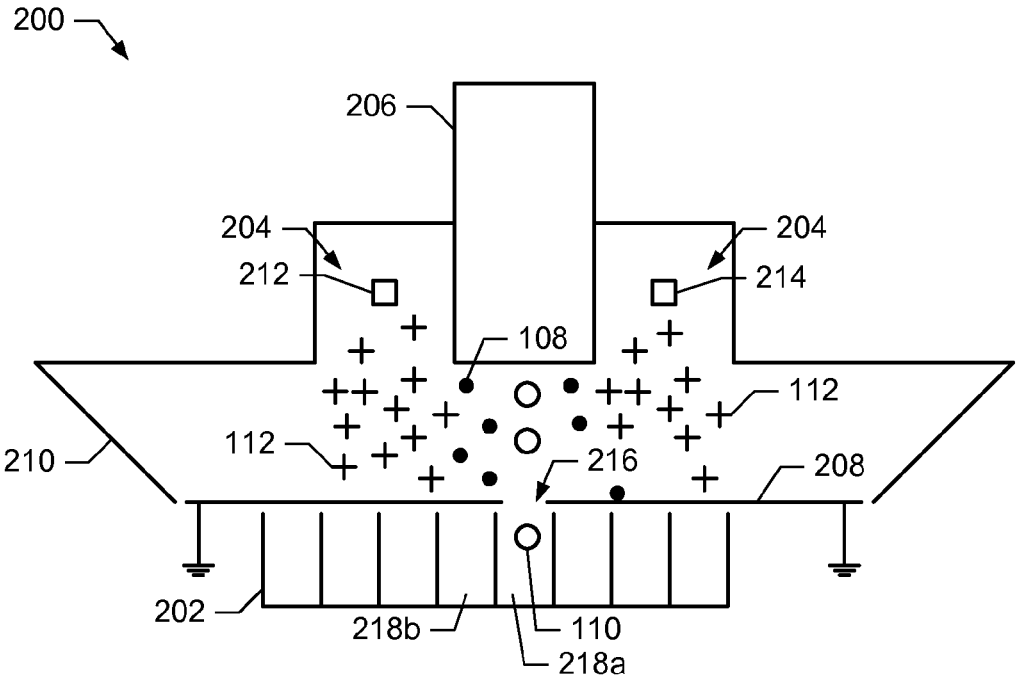
FIG. 2 illustrates an example fluid jetting apparatus to deposit fluid droplets onto a substrate and to collect aerosol particles using a passive aerosol collector, constructed in accordance with the teachings herein.

FIG. 2 illustrates an example fluid jetting apparatus 200 to deposit fluid droplets 110 onto a substrate 202 and to collect aerosol particles 108 using a passive aerosol collector 204. The example fluid jetting apparatus 200 further includes a fluid jetting head 206, which ejects fluid droplets 110 toward the substrate 202. The fluid droplets 110 land on desired locations on the substrate 202. For example, a desired location on an assay plate may be a particular test well into which a desired amount of fluid is to be injected via the ejection of fluid droplets 110 from the fluid jetting head 206.

The example passive aerosol collector 204 of FIG. 2 is included to collect or capture aerosol particles 108 ejected from the fluid jetting head 206, and includes a reference plate 208, a housing 210, and corona wires 212, 214. The corona wire 212 is positioned on a first side of the fluid jetting head 206, and the corona wire 214 is positioned on a second side of the fluid jetting head 206 opposite the corona wire 212. The example reference plate 208 is connected to a ground or reference potential to provide a reference for the corona wires 212, 214 to operate. The reference plate 208 of FIG. 2 includes an opening 216 through which the fluid droplets 110 travel to the substrate 202. In the illustrated example, the opening 216 is large enough to permit the fluid droplets 110 to travel through without a substantial risk of impacting the sides of the opening (e.g., the reference plate 208), but is also smaller than an opening of the container 218*a* in the substrate 202. As a result, the opening 216 permits the fluid droplets 110 to be deposited in the containers 218*a*, 218*b* and substantially prevents contamination of an adjacent container 218*b* with fluid droplets 110 intended to be deposited in a first container 218*a*.

The housing 210 encloses a space between the fluid jetting head 206 and the substrate 202 to contain the aerosol particles 108 within the housing 210. As the aerosol particles 108 disperse within the housing 210, the aerosol particles 108 travel between the corona wires 212, 214 and the reference plate 208. The corona wires 212, 214 generate ions 112, which travel toward the reference plate 208. As mentioned above, the ions 112 force the aerosol particles 108 toward the reference plate 208. The plate 208 collects the aerosol particles 108 to reduce or prevent contamination of other portions of the fluid jetting apparatus 200 or an external environment.

In the illustrated example, the reference plate 208 may be removed from the fluid jetting apparatus 200, disposed of, and/or cleaned and replaced. For example, the substrate 202 may include the reference plate 208 as a cover, as an aerosol collection surface, and/or as a drop discriminator. In such an example, the reference plate 208 is removed when the substrate 202 has completed a fluid jetting procedure and may be disposed of (i.e., the plate 208 is a consumable product). In examples where the substrate 202 is an assay plate or other consumable or disposable item, the addition of the reference plate 208 to the substrate 202 does not add substantial cost to the substrate 202. In the illustrated example of FIG. 2, the substrate 202 is an assay plate including an array of discrete containers 218*a*, 218*b* into which the fluid droplets 110 are directed.

In operation, the substrate 202 and/or the fluid jetting apparatus 200 move such that one of the discrete containers (e.g., the container 218*a*) is positioned within an ejection path of the fluid jetting head 206. When the fluid jetting head 206 ejects fluid droplet(s) 110, the droplet(s) 110 travel through the opening 216 in the reference plate 208 and into the container 218*a*. The example fluid jetting apparatus 200 pauses for about 1 second to permit the aerosol particles 108 within the housing 210 to sufficiently disperse and be captured by the corona wires 212, 214. After pausing, the fluid jetting apparatus 200 and/or the substrate 202 moves to position another container (e.g., the container 218*b*) adjacent the opening 216. In this manner, the example fluid jetting apparatus 200 efficiently captures aerosol particles resulting from fluid jetting operations.

Figure 3:
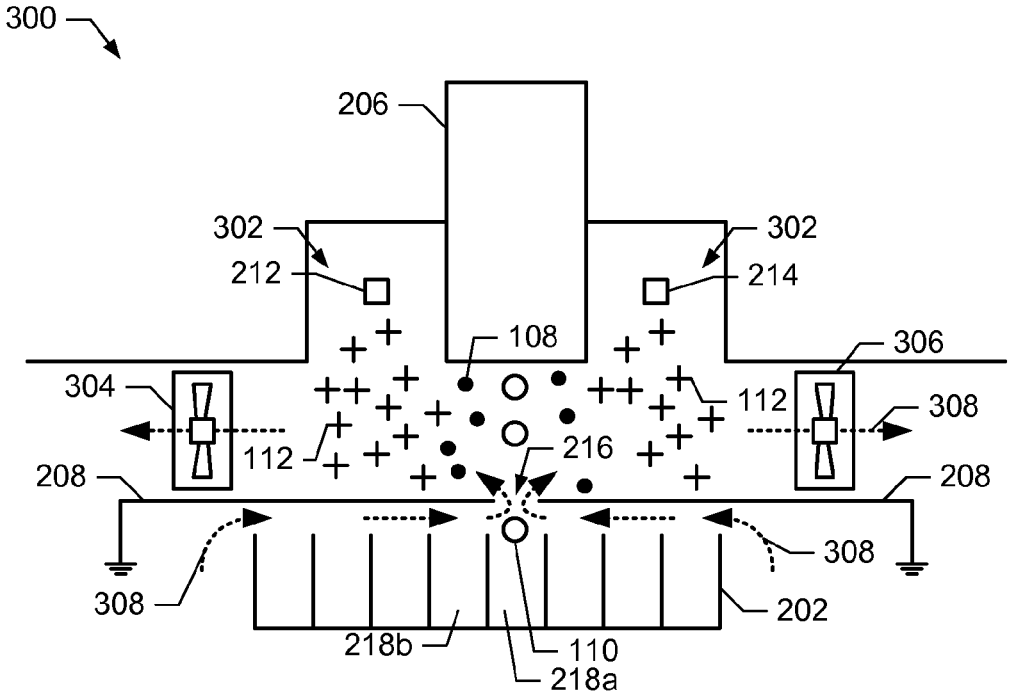
FIG. 3 illustrates an example fluid jetting apparatus to deposit fluid droplets onto a substrate and to collect aerosol particles using an active aerosol collector, constructed in accordance with the teachings herein.

FIG. 3 illustrates an example fluid jetting apparatus 300 to deposit fluid droplets onto a substrate 202 and to collect aerosol particles 108 using an active aerosol collector 302. The fluid jetting apparatus 300 of FIG. 3 includes the fluid jetting head 206 of FIG. 2, which ejects fluid droplets 110 toward the substrate 202. The example active aerosol collector 302 of FIG. 3 allows the example fluid jetting apparatus 300 to deposit fluid droplets 110 onto the substrate 202 more quickly than the example fluid jetting apparatus 200 of FIG. 2, while still reducing or avoiding escape of aerosol particles 108. However, the example active aerosol collector 302 may be more expensive and/or occupy a larger area to implement in a fluid jetting apparatus than the passive aerosol collector 204 of FIG. 2.

Like the example passive aerosol collector 204 illustrated in FIG. 2, the example active aerosol collector 302 of FIG. 3 includes a reference plate 208, and corona wires 212, 214. However, unlike the passive aerosol collector 204 of FIG. 2, the example active aerosol collector 302 includes fans 304, 306 (or other types of air agitators such as suction pumps) to cause the fluid aerosols particles 108 to be carried or urged into the area between the corona wires 212, 214 and the reference plate 208, and to be captured on the reference plate 208 more quickly than would be achieved with the corona wires in the absence of the fans 304, 306. In particular, the example fans 304, 306 generate an airflow 308 that pulls air through the opening 216 in a direction opposite that of ejection of the fluid droplets 110. Unlike known suction devices used in aerosol collection systems, the example fans 304, 306 are relatively low-power, low-noise fans (e.g., 12V fans) that generate small amounts of air flow that are sufficient to move the fluid aerosol particles 108 into the area between the corona wires 212, 214 and the reference plate 208.

The example active aerosol collector 302 further uses the fans 304, 306 to discriminate between the fluid droplets 110 and the aerosol particles 108 at the opening 216. In particular, the example fans 304, 306 generate an airflow having a speed that creates sufficient airflow 308 at the openings 216 to substantially prevent the aerosol particles 108 from traveling through the opening 216 (e.g., via air drag) while permitting the fluid droplets 110 to overcome the airflow 308 to exit the opening 216 and travel to the substrate 202. In this manner, the example openings 216 function as drop discriminators. To this end, the speed of the fans 304, 306 of the illustrated example is based on the sizes of the fluid droplets 110, the diffusion speed of the fastest (e.g., smallest) aerosol particles 108, and the characteristic dimension of the opening 216 (as used to determine the Péclet number). The example aerosol particles 108 of the illustrated example have a volume as small as 0.1 femtoliters (fL) (e.g., a radius of about 0.2 micrometers (μm)), and the example opening 216 has a radius of about 0.7 millimeters. If the diffusion speed of the aerosol particles 108 is assumed to be about 1 m/s, the example fans 304, 306 may generate an airflow having a velocity of about 0.1 m/s at the respective locations of the fans 304, 306 to prevent escape of the aerosol particles 108 through the opening 216 while avoiding substantial interference with the trajectory of the fluid droplets 110. However, changes in the sizes of the smallest aerosol particles 108 and/or the fluid droplets 110 may cause the fans 304, 306 to generate airflows having different speeds.

In the example of FIG. 3, the fluid jetting head 206 ejects the fluid droplets 110 with sufficient speed to overcome the speed of the airflow 308 and to be deposited on the substrate 202 (e.g., in the container 218*a*). However, the airflow 308 reduces or prevents the aerosol particles 108 from traveling through the opening 216 and, instead, urges the fluid aerosol particles 108 into the area between the corona wires 212, 214 and the reference plate 208. When the aerosol particles 108 travel (e.g., are carried by the airflow 308) between the corona wire 212, 214 and the reference plate 208, the ions 112 generated by the corona wire 212, 214 force the aerosol particles 108 toward the reference plate 208. In this manner, the example fluid jetting apparatus 300 efficiently captures aerosol particles resulting from fluid jetting operations using size discrimination of the fluid particles and droplets with air drag. The example active aerosol collector 302 of FIG. 3 advantageously maintains aerosol collection performance when the substrate 202 and/or the fluid jetting apparatus 300 does not pause between fluid jetting operations.

Figure 4:
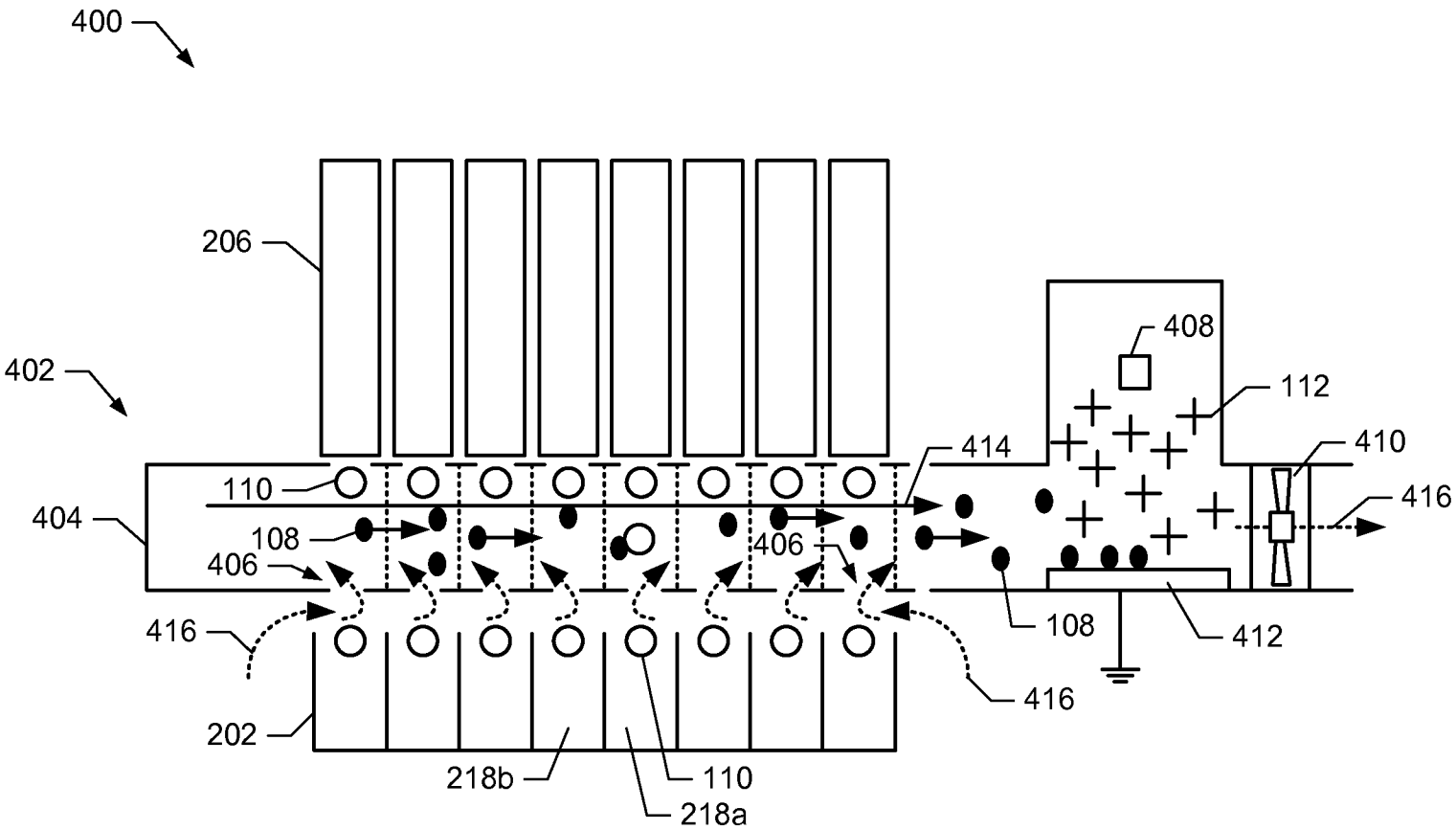
FIG. 4 illustrates an example fluid jetting apparatus to deposit fluid droplets onto a substrate and to collect aerosol particles using an aerosol diverter, constructed in accordance with the teachings herein.

FIG. 4 illustrates an example fluid jetting apparatus 400 to deposit fluid droplets 110 onto a substrate 202 and to collect aerosol particles 108 using an aerosol diverter 402. The example fluid jetting apparatus 400 includes a plurality of fluid jetting heads 206 to eject respective fluid droplets 110 onto a substrate 202. The example fluid jetting heads 206 eject the fluid droplets 110 in accordance with instructions from a controller. In some examples, the heads 206 eject fluid droplets 110 substantially simultaneously to apply the fluid droplets 110 to the substrate 202. As illustrated in FIG. 4, the aerosol diverter 402 is positioned between the example fluid jetting heads 206 and a travel path of the substrate 202 to permit the fluid droplets 110 to travel to the substrate 202 while diverting fluid aerosol particles 108 for capture.

In the illustrated example, the aerosol diverter 402 includes a manifold 404, a plurality of openings 406 through which the fluid droplets 110 travel to the substrate 202, a corona wire 408 to capture the aerosol particles 108, a fan 410, and a collection surface 412. The example openings 406 of FIG. 4 are separated (e.g., by baffles or other barriers), but are each in communication with a combined flow path 414 through which the aerosol particles 108 travel toward the corona wire 408. The manifold 404 combines the aerosol particles 108 that travel through the openings 406 by diverting the aerosol particles 108 from the individual openings 406 to the combined flow path 414. Additional illustrations of the example manifold 404 are provided in FIGS. 5 and 6.

In operation, the example aerosol diverter 402 (e.g., via the fan 410) generates an airflow 416 that enters the manifold 404 through the openings 406 and flows toward the corona wire 408. The airflow 416 results in a suction at the openings 404, which pulls a large portion of the example aerosol particles 108 into the manifold 404 from either side of the openings 406. The aerosol diverter 402 diverts the aerosol particles 108 from the openings 404 to an area between the corona wire 408 and the collection surface 412 (and/or reference plate). The example corona wire 408 generates a plurality of ions 112, which travel from the corona wire 408 toward the collection surface 412 due to an electric field present between the corona wire 408 and the collection surface 412. As the aerosol particles 108 travel with the airflow 416, the ions 112 force the aerosol particles toward the collection surface 412. The airflow 416 continues to the fan 412 and exits the aerosol diverter 402 substantially free of aerosol.

Figure 5:
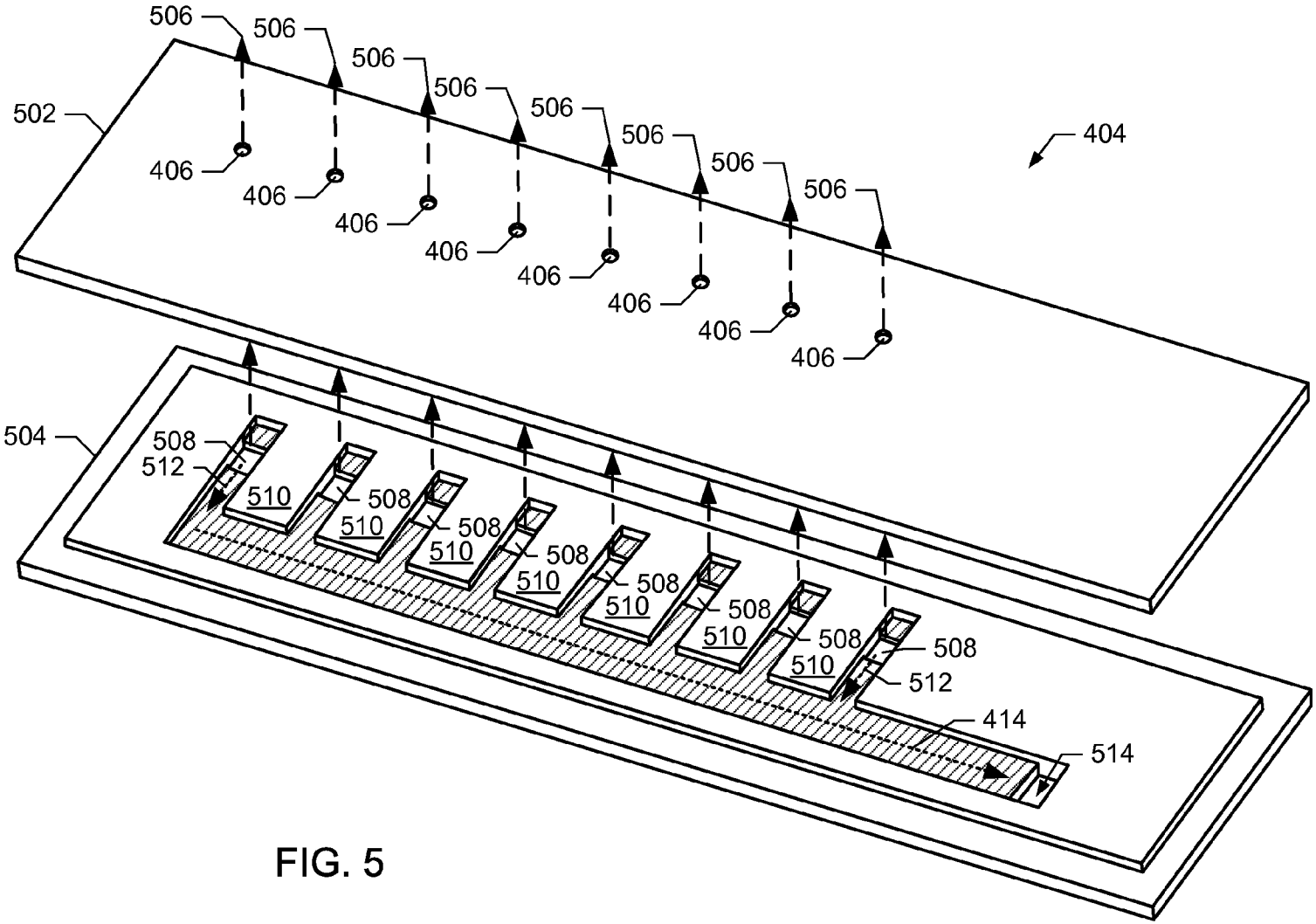
FIG. 5 is an exploded view of an example manifold that may be used to implement the example aerosol diverter of FIG. 4.

FIG. 5 is an exploded view of the example manifold 404 of FIG. 4. The manifold 404 of the illustrated example includes a drop discriminator 502 and an aerosol combiner 504. While shown in exploded view in FIG. 5, the example drop discriminator 502 and the example aerosol combiner 504 of FIG. 5 are attached to each other to form the manifold 404. The drop discriminator 502 includes the openings 406, into which fluid droplets 110 and aerosol particles 108 are ejected by the example fluid jetting head(s) 206 of FIG. 4 in the direction 506 indicated in FIG. 5. The example drop discriminator 502 of FIG. 5 permits the fluid droplets 110 to pass through the openings 406 and diverts aerosol particles 108 to prevent the particles 108 from escaping through the openings 406. The aerosol combiner 504 includes openings 508 that align with the example openings 406 in the drop discriminator 502. The example manifold 404 of the illustrated example is installed in a fluid jetting apparatus (e.g., the fluid jetting apparatus 400 of FIG. 4) such that the aerosol combiner 504 is adjacent the fluid jetting head(s) 206. In some examples, the aerosol combiner 504 is installed in contact with the fluid jetting head(s) 206 and, thus, the aerosol particles 108 cannot escape between the fluid jetting head(s) 206 and the fluid jetting head(s) 206. The example fluid droplets 110 and aerosol particles 108 are ejected into the openings 508 and the fluid droplets exit the openings 406. As illustrated in FIG. 5, adjacent openings 406, 508 are separated by barriers 510 (e.g., baffles) that prevent contamination of adjacent portions of a substrate 202.

In some examples, the drop discriminator 502 is in circuit with a reference voltage (e.g., a ground reference). Corona wires, such as the corona wires 212, 214 of FIGS. 2 and 3, may then be provided adjacent the print head(s) 206 to capture aerosol particles 108 that do not enter the opening(s) 508. By connecting the drop discriminator 502 in circuit with the reference voltage, the drop discriminator 502 may also function as a reference plate (e.g., the reference plate 208 of FIGS. 2 and 3) for the corona wire(s) 212, 214.

Figure 6:
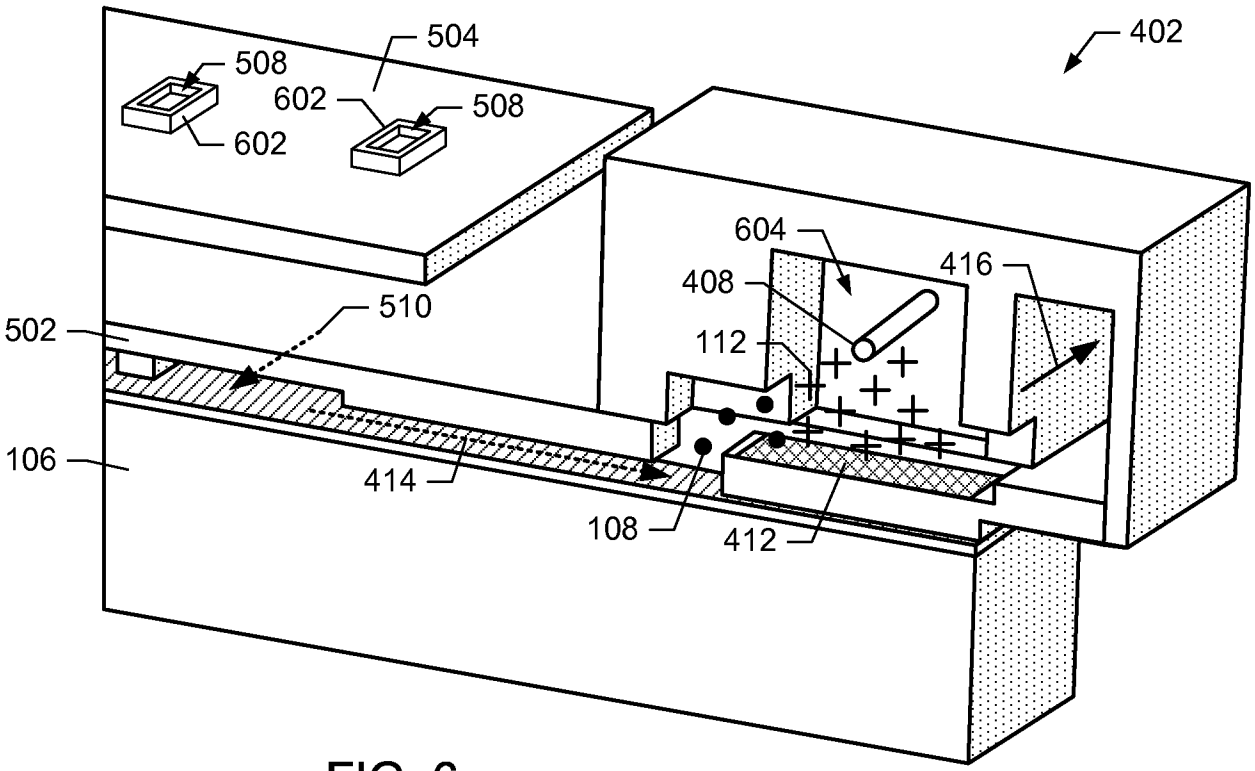
FIG. 6 is a cross-sectional view of the example aerosol diverter of FIGS. 4 and 5.

Aerosol particles 108 that enter the opening 406 are discouraged and/or prevented from traveling through the respective opening 508 by the airflow(s) 416. Instead, the aerosol particles 108 are diverted to a respective branch of an aerosol collection path 512. As shown in FIG. 5, the collection path 512 is in communication with each respective pair of openings 406, 508. The branches of aerosol collection path 512 converge into the combined flow path 414 illustrated in FIG. 4. The combined flow path 414 of the illustrated example directs the aerosol particles 108 to a manifold output 514, where the aerosol particles 108 are directed to the corona wire 408 as illustrated in FIG. 6.

In the example of FIG. 5, the manifold 404 is constructed such that the distance between the respective pairs of openings 406, 508 is sufficiently high to allow the aerosol particles 108 to slow to a steady-state speed (e.g., a speed and/or direction consistent with surrounding airflows, such as the airflow 416 of FIG. 4), but not so high as to allow the fluid droplets 110 to slow to the steady-state speed. For example, the distance between the respective pairs of openings 406, 508 may be determined based on an ejection speed (e.g., of the droplets 110 and aerosol particles 108) from the fluid jetting head(s) 206 and a relaxation time $t_r$. The relaxation time tr of the fluid droplets 110 and/or the aerosol particles 108 may be approximated using Equation 1 below.

$$t_r = \frac{\rho * d_p^2}{18\mu} \qquad \text{(Equation 1)}$$

In Equation 1, ρ is the density of the fluid droplets 110 or the fluid aerosol particles 108 (e.g., 1000 kilograms per cubic meter ($kg/m^3$) for water), dp is the diameter of a fluid droplet 110 and/or a fluid aerosol particle 108, and μ is the dynamic viscosity of the surrounding fluid (e.g., air in the illustrated example of FIG. 5, which has a dynamic viscosity of about $1.5\times10^{-5}$ square meters per second ($m^2/s$)). Accordingly, $d_p$ will be different between the fluid droplets 110 and the fluid aerosol particles 108, and an appropriate distance between the pairs of openings 406, 508 may be selected based on the difference in the diameters.

The example fluid jetting head(s) 206 and/or the example manifold 404 of FIGS. 4 and 5 may advantageously be constructed using inexpensive materials. In some examples, the fluid jetting head(s) 206 may be used to perform experimental reactions between different substances and, thus, contamination of the materials making up these reactions is undesirable. The fluid jetting head(s) 206 are then replaced with clean fluid jetting head(s) to perform a subsequent experimental reaction in which different substances are ejected. As a result, because the manifold 404 may be contaminated with substances from one experiment, the manifold 404 is advantageously removable from the fluid jetting apparatus 400 and disposable. For example, the manifold 404 may be removed when a substrate 202 is removed to reduce contamination of later inserted substrates and/or jetted fluids. To this end, the example manifold 404 (e.g., the drop discriminator 502 and/or the aerosol combiner 504) of the illustrated example is constructed using inexpensive materials, such as polyamide, inexpensive plastics, and/or any other material.

FIG. 6 is a cross-sectional view of the example aerosol diverter 402 of FIGS. 4 and 5. In particular, the example aerosol diverter 402 of FIG. 6 illustrates the example corona wire 408, the example aerosol collector 412, the example combined flow path 414, the example drop discriminator 502, the example aerosol combiner 504, and the example openings 508 of FIG. 5. The example aerosol combiner 504 of FIG. 6 further includes fluid ejection guides 602 surrounding the openings 508 in the aerosol combiner 504. The example manifold 404, the example drop discriminator 502 and the example aerosol combiner 504 are installed in the example fluid jetting apparatus 200 or 300 of FIGS. 2 and 3 such that the fluid ejection guides 602 of FIG. 6 contact the example fluid ejection head(s) 206 to reduce or prevent aerosol particles 108 from escaping between the fluid ejection head(s) 206 and the aerosol combiner 504. As illustrated in FIGS. 4-6, the example aerosol diverter 402 is modular. That is, the example corona wire 408, the example aerosol collector 412, the example drop discriminator 502, and/or the example aerosol combiner 504 may be separated from each other to facilitate insertion, removal, cleaning, disposal, and/or replacement. Any of the example corona wire 408, the example aerosol collector 412, the example drop discriminator 502, and/or the example aerosol combiner 504 may additionally or alternatively be combined or integrated.

As illustrated in FIG. 6, the aerosol particles 108 flow through the combined flow path 414 to a collection area 604 located between the corona 408 and the aerosol collector 412. The corona 408 generates ions 112 to force the aerosol particles 108 toward and onto the aerosol collector 412, thereby removing the aerosol particles 108 from the airflow 416. The airflow 416 then exits the aerosol diverter 402 to, for example, an external environment.

All or a portion of the example aerosol diverter 402 of FIG. 4 may be removed from the fluid jetting apparatus 400 to be disposed of or cleaned and replaced. Split low cost disposable parts from non-contaminated portion like fan, 404 can be disposed of, but corona and fan remain in machine. Split corona from 404. In some examples, the drop discriminator 502, the aerosol combiner 504 and/or, more generally, the manifold 404 are replaced when the substrate 202 is introduced into the fluid jetting apparatus 400 and removed when the substrate 202 is removed. In some examples, the corona wire 408, the fan 410, and/or the collection surface 412 are not removed from the fluid jetting apparatus 400 because these components are reusable and do not pose a substantial risk of contaminating subsequent substrates, manifolds and/or, in general, experimental reactions between substances. In some applications, the disposal of the drop discriminator 502, the aerosol combiner 504, and/or the manifold 404 does not add substantial substrate costs to operating the fluid jetting apparatus 400 because such components may be designed and inexpensively manufactured for disposal.

While the example aerosol collectors 204 and 302 of FIGS. 2 and 3 are described separately from the aerosol diverter 402 of FIG. 4 in the above examples, the example aerosol diverter 402 of FIG. 4 may be combined with either of the aerosol collectors 204, 302 to further improve aerosol collection in a fluid jetting device. For example, the aerosol diverter 402 of FIG. 4 (e.g., via the drop discriminator 502 of FIG. 5) may be used to provide the reference plate 208 for the aerosol collectors 204, 302. In such an example, the drop discriminator 502 is coupled to a ground reference to provide a reference for the coronas 212, 214.

From the foregoing, it will be appreciated that the above disclosed methods and apparatus efficiently capture aerosol particles during fluid jetting operations in which fluid is to be jetted onto relatively thick substrates. In some example applications such as fluid jetting apparatus that inject precise quantities of fluid onto a substrate, example disclosed methods and apparatus reduce or prevent contamination of locations adjacent a fluid jetting location with the jetted fluid. As a result, example methods and apparatus disclosed herein achieve more accurate quantities of fluid jetting, reduce or prevent undesired mixtures of fluids, and/or escape of aerosol(s) associated with the jetted fluid(s) into an external environment. Example methods and apparatus disclosed herein achieve these benefits using less noise, less power, and less cost to implement and/or manufacture than known filtering methods (e.g., by avoiding noisy and costly vacuum suction and/or other aerosol capture and/or containment devices or filters).

Although certain example methods and apparatus have been described herein, the scope of coverage of this patent is not limited thereto. On the contrary, this patent covers all methods and apparatus fairly falling within the scope of the claims of this patent.

What is claimed is:

1. A fluid jetting apparatus, comprising:

a fluid jetting head to eject fluid droplets toward a substrate;

a manifold positioned between the fluid jetting head and the substrate, the manifold comprising a first opening facing the fluid jetting head and a second opening facing the substrate, the manifold being positioned to permit an air flow to enter an interior of the manifold via the second opening; and a fan to generate the air flow and to expel the air flow reaching the fan from the interior of the manifold for collection of aerosol particles associated with the fluid droplets at a collection surface, the manifold and the air flow to permit the fluid droplets to reach the substrate via the first and second openings and to entrain the aerosol particles in the air flow without the aerosol particles exiting the manifold via the second opening.

2. An apparatus as defined in claim 1, further comprising a corona wire to generate ions to direct the aerosol particles toward the collection surface.

3. An apparatus as defined in claim 2, wherein the fan is to generate the air flow to divert the aerosol particles toward an area between the collection surface and the corona wire.

4. An apparatus as defined in claim 3, wherein the manifold comprises a drop discriminator having the second opening, the air flow to substantially prevent the aerosol particles from traveling through the second opening toward the substrate.

5. An apparatus as defined in claim 3, wherein the manifold is removable with the substrate.

6. An apparatus as defined in claim 1, wherein the fluid jetting head is one of a plurality of fluid jetting heads, the manifold to combine the aerosol particles from the plurality of fluid jetting heads.

7. An apparatus as defined in claim 6, wherein the manifold comprises a drop discriminator including a plurality of openings through which the fluid droplets are to travel to reach the substrate, the plurality of openings including the second opening.

8. An apparatus as defined in claim 7, wherein the manifold comprises a plurality of aerosol flow paths in communication with respective ones of the plurality of openings of the drop discriminator, the aerosol flow paths in communication with a combined flow path to divert the aerosol particles from the plurality of openings of the drop discriminator to the collection surface, the aerosol flow paths to permit the fluid droplets to travel through the manifold to the substrate.

9. An apparatus as defined in claim 7, wherein adjacent ones of the plurality of openings of the drop discriminator are separated by a barrier.

10. An apparatus as defined in claim 2, further comprising a reference plate positioned below the corona wire and above the substrate, the reference plate to provide a reference potential to direct the ions toward the reference plate to force the aerosol particles associated with the fluid droplets toward the reference plate.

11. A fluid jetting apparatus, comprising:

fluid jetting heads to eject respective volumes of fluid droplets toward a substrate;

a manifold positioned between the fluid jetting heads and the substrate, the manifold comprising first openings facing the fluid jetting heads and second openings facing the substrate, the manifold being spaced apart from the substrate to permit an air flow to enter an interior of the manifold via the second openings; and a fan to generate the air flow and to expel the air flow reaching the fan from the interior of the manifold for collection of aerosol particles associated with the fluid droplets at a collection surface, the manifold and the air flow to permit the fluid droplets to reach the substrate via the first openings and the second openings and to entrain the aerosol particles in the air flow without the aerosol particles exiting the manifold via the second openings.

12. An apparatus as defined in claim 11, further comprising a corona wire to generate ions to direct the aerosol particles toward the collection surface.

13. An apparatus as defined in claim 12, wherein the fan is to generate the air flow to divert the aerosol particles toward an area between the collection surface and the corona wire.

14. An apparatus as defined in claim 11, wherein the substrate is an assay plate, corrugated cardboard, or a textile.

15. An apparatus as defined in claim 11, wherein the manifold comprises:

barriers between corresponding pairs of the first openings and the second openings; and a combined flow path in fluid communication with the first openings and the second openings, the fan to generate the air flow to direct the aerosol particles to the combined flow path.

16. An apparatus as defined in claim 15, wherein the barriers and the air flow are to prevent cross-contamination of substances ejected from different ones of the fluid jetting heads on the substrate.

* * * * *